US005918560A

United States Patent [19]

Dasher et al.

[11] Patent Number: 5,918,560

[45] Date of Patent: Jul. 6, 1999

[54] TEXTILE FOLD CONTROL SYSTEM WITH HEM ENGAGER

[75] Inventors: Preston B. Dasher; John S. Chamlee, both of Lawrenceville; Tadeusz Olewicz, Houschton, all of Ga.

[73] Assignee: Atlanta Attachment Company, Lawrenceville, Ga.

[21] Appl. No.: 08/971,612

[22] Filed: Nov. 17, 1997

[51] Int. Cl.[6] ..... D05B 9/00

[52] U.S. Cl. ..... 112/475.06; 112/141; 112/147; 112/153

[58] Field of Search ..... 112/141, 143, 112/470.33, 475.03, 475.08, 475.09, 153, 147, 470.29, 306, 320, 475.06, 475.01

[56] References Cited

U.S. PATENT DOCUMENTS

| | | | |
|---|---|---|---|
| 2,861,801 | 11/1958 | Cran | 270/68 |
| 3,094,321 | 6/1963 | Kamberg | 270/68 |
| 3,260,518 | 7/1966 | Kamberg et al. | 270/62 |
| 3,554,354 | 1/1971 | Reid et al. | 198/33 |
| 3,783,805 | 1/1974 | Guichard | 112/147 X |
| 4,046,087 | 9/1977 | Manetti | 112/121.15 |
| 4,343,255 | 8/1982 | Kelly et al. | 112/262.3 |
| 4,473,017 | 9/1984 | Letard et al. | 112/147 X |
| 4,526,115 | 7/1985 | Kosrow et al. | 112/262.3 |
| 4,665,848 | 5/1987 | Michaels et al. | 112/147 X |
| 4,681,051 | 7/1987 | Kirch et al. | 112/306 |
| 4,800,830 | 1/1989 | Adamski et al. | 112/303 |
| 4,911,092 | 3/1990 | Adamski, Jr. et al. | 112/121.15 |
| 4,922,842 | 5/1990 | Adamski et al. | 112/304 |
| 5,070,799 | 12/1991 | Montgomery et al. | 112/470.33 X |
| 5,152,235 | 10/1992 | Goto et al. | 112/63 |
| 5,269,239 | 12/1993 | Adamski, Jr. et al. | 112/306 X |
| 5,370,072 | 12/1994 | Adamski et al. | 112/262.3 |
| 5,437,238 | 8/1995 | Price et al. | 112/470.29 |
| 5,522,332 | 6/1996 | Price et al. | 112/470.29 |
| 5,524,563 | 6/1996 | Huddleston | 112/141 |
| 5,562,060 | 10/1996 | Price et al. | 112/470.29 |
| 5,657,711 | 8/1997 | Price et al. | 112/470.33 |

*Primary Examiner*—Ismeal Izaguirre
*Attorney, Agent, or Firm*—Womble Carlyle Sandridge & Rice

[57] ABSTRACT

A textile fold control system (40) includes a hem engager (46) mounted to a downstream side of a sewing machine (42), and a roller (76) for engaging and moving a hem formed in a textile work piece slightly downward so as to bend the hem about a trailing edge (79) of a work surface (54) of the sewing machine, thereby applying increased frictional contact between an edge portion (88) of the work piece and the work surface, and additional surface-to-surface contact between the edge portion and an adjacent body portion (90) of the hem in order to avoid the curling or unfolding of the hem during a pre-feed portion of the sewing cycle of the sewing machine.

11 Claims, 3 Drawing Sheets

TEXTILE FOLD CONTROL SYSTEM WITH HEM ENGAGER

FIELD OF THE INVENTION

This invention relates to a system for controlling a folded hem of a textile work piece as the hem is moved away from a folder and beneath the sewing needles of a sewing machine in a pre-feed portion of a sewing cycle, before the presser foot and needles of the sewing machine are placed in operation.

BACKGROUND OF THE INVENTION

When a hem is first formed in a textile work piece and later is sewn closed by a sewing machine, it is difficult to accurately form the beginning of the hem so that the depth of fold of the hem is the same at the beginning of the sewing run as it is at the end of the sewing run. In a situation where the work piece has a continuous edge that is to be folded over and sewn to complete the hem, for example the waist hem of a tubular knitted shirt, the fold that is being formed at the edge of the work piece will be a continuous fold about the circular waist edge of the shirt. It is important, therefore, that the end of the folded hem match up with the beginning of the folded hem as the sewing machine completes its cycle of operation, so that a continuous hem is formed.

A procedure that has been used in the past for forming a continuous folded hem about the circular edge of a textile work piece is to begin the folding operation during a pre-feed movement of the work piece before the sewing function is initiated. The edge of the work piece is placed under tension and is advanced through the sewing station with the needles and presser foot of the sewing machine raised out of the way and inoperative. The folding mechanism that is used to form the fold in the edge of the work piece is placed in operation so that the fold of the hem is formed for a short time period before the sewing function begins, with the edge portion of the work piece being turned under the adjacent body portion of the work piece. This pre-feed movement delays the start of the sewing cycle and thus allows the hem to be formed before the sewing function is started.

While the above-described pre-feed sequence accomplishes a fold in the work piece as it emerges from the folder, the presser foot, being raised and therefore inoperative, does not maintain the fold in the edge of the work piece as the work piece advances across the work surface of the sewing station. Likewise, the inoperative sewing needles do not perform their stitching function to sew the fold into the work piece. As a result, the tensioned edge portion of the folded hem tends to curl and to progressively unfold itself as it advances away from the folder, across, and beyond the sewing station during the pre-feed portion of the cycle of the system. The result of this phenomenon is that the depth of the overfolded portion of the hem that is sewn by the sewing machine is likely to be smaller and not as perfectly formed at the beginning of the line of stitching than it is at the end of the line of stitching. This tends to create a visual flaw in the hem and increases the risk of the textile piece becoming a "second" which is unacceptable to the potential purchaser of the work piece.

Thus, it can be seen that there is a need for a simple system for accurately establishing and maintaining the fold in a hem formed at and along the edge of a work piece during the pre-feed sequence of the sewing system, and before the presser foot and sewing needles are started for sewing the hem into the work piece.

SUMMARY OF THE INVENTION

Briefly described, the present invention comprises a textile fold control system that holds the unsewn folded edge portion of a textile work piece in its folded configuration after the work piece has been folded and is being advanced, in a lightly stretched condition, through a sewing station and downstream beyond the sewing station during a pre-feed portion of the a system sewing cycle. A folder is positioned upstream of the sewing station. The sewing needles and presser foot are located in the sewing station and are activated by a conventional sewing machine after the pre-feed portion of the cycle of operation. The folder turns the edge portion of the textile work piece under an adjacent body portion of the work piece so that the edge portion slides in contact with the horizontal bed of the sewing machine. In the embodiment disclosed herein, a hem engager is positioned immediately downstream of the work surface of the sewing machine, and is arranged to urge the folded hem of the work piece downwardly so as to cause a change of direction of the work piece as it advances beyond the sewing needles, beyond the presser foot, and off of the horizontal work surface of the sewing machine.

This change in direction of the work piece hem causes the folded edge portion of the work piece to more positively engage the horizontal bed of the sewing machine, and also causes the overlying adjacent body portion of the work piece to more positively engage the edge portion of the work piece. As a result, the two plies of the work piece tend to frictionally engage each other, which tends to avoid any change of position of the two plies with respect to each other prior to being sewn together in a hem. In addition to the frictional engagement of the two plies to each other, the folded under edge portion of the hem, which is the bottom ply of the hem, is held against the bed plate of the machine. This engagement of the bottom ply of the hem with the bed plate reduces the tendency of the bottom ply to curl out of position.

As the unsewn folded hem is advanced a predetermined distance during the pre-feed sequence of the sewing system, the folded hem is initially formed and is stabilized so that the sewing function can begin by lowering the presser foot into engagement with the hem and engaging the work piece with the sewing needles. Once the sewing function has begun, the lines of stitches formed by the sewing needles retain the folded hem in a fixed position with respect to the remainder of the work piece, with the edge portion of the hem being of substantially equal depth throughout the entire length of the hem.

It is, therefore, an object of this invention to provide an improved textile fold control system which accurately maintains the fold in a hem of a textile work piece as the fold is moved downstream away from a folder, through a sewing station, and downstream beyond the sewing station during a pre-feed sequence of the sewing cycle.

Another object of this invention is to provide an improved textile fold control system which is inexpensive to manufacture and to install, and whose principle of operation is uncomplicated and is reliable, for holding an unsewn fold in the hem of a textile work piece during a pre-feed operation of a sewing cycle.

Other objects, features and advantages of the present invention will become apparent upon reading the following specification, when taken in conjunction with the accompanying drawings.

DETAILED DESCRIPTION

Figure 3:
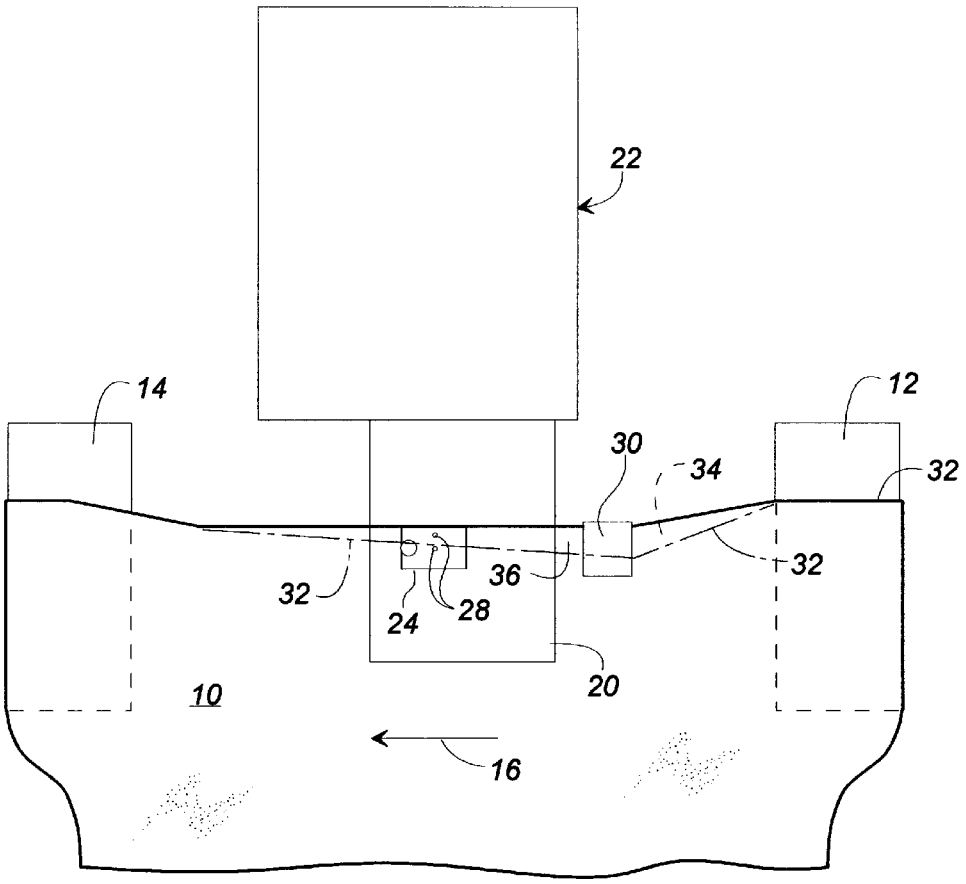
FIG. 3 PRIOR ART
FIGS. 2 and 3 are illustrations of the operation of typical prior art hem folder systems, with FIG. 2 being a schematic end elevational view of the prior art system, and FIG. 3 being a schematic plan view of the prior art system.
Figure 2:
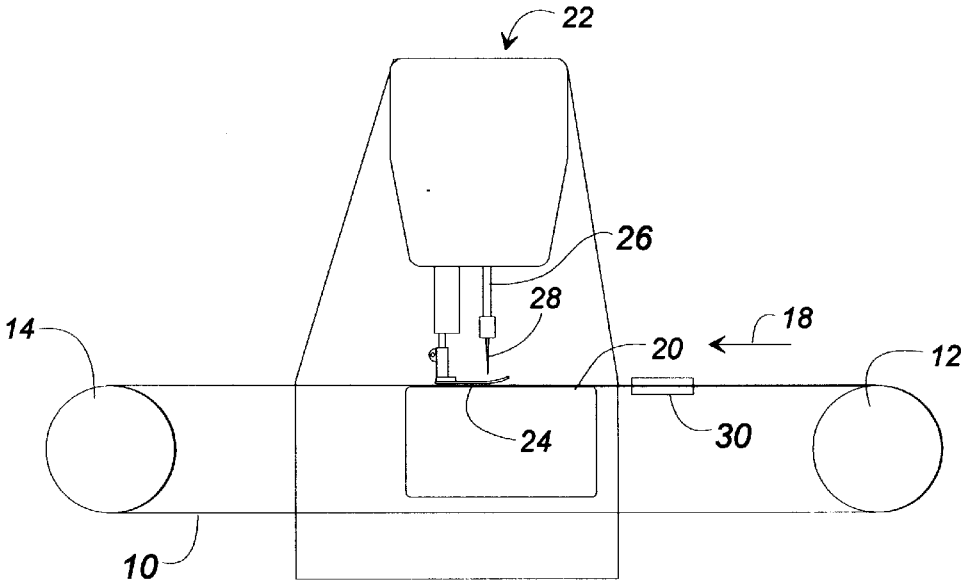
FIG. 2 PRIOR ART

Referring now in more detail to the drawings, in which like numerals indicate like parts throughout the several views, FIGS. 2 and 3 schematically illustrate typical prior art systems for forming a folded hem in an unfinished or "raw" continuous edge of a tubular work piece 10, such as the waist edge of a knit shirt. The waist edge of the work piece is placed about spindles 12 and 14, and the spindles are rotated so as to advance the work piece in the direction of arrows 16 and 18 across the work surface 20 of a sewing machine 22. The sewing machine 22 is of conventional construction, and includes a presser foot 24 and a needle bar 26, with a pair of side-by-side needles 28 that reciprocate through the presser foot and through the work piece 10. A folder 30 is positioned upstream of the sewing machine.

As the unfinished or raw edge 32 of the work piece 10 advances from the upstream spindle 12 toward the sewing machine 22, the folder turns the raw edge 32 underneath the adjacent body portion 34 of the work piece to form a two-ply fold that is advanced onto the work surface 20 of the sewing machine, and passed beneath presser foot 24 and needles 28, and eventually off of the work surface 20, toward the downstream spindle 14. Typically, the spindles 12 and 14 are positioned a distance apart in order to create tension in the work piece 10 at the hem 36.

After the hem 36 has been formed by the prior art folder 30, the tension in the work piece tends to cause the edge portion 32 of the work piece to curl and stretch, and to unfold the hem, so that the hem begins to progressively change its shape after it leaves the folder. In most cases, the folder 30 will be placed closely adjacent the work surface 20 of the sewing machine, so that there is only a short distance for the hem 36 to travel between the folder 30 and the needles 28 and presser foot 24. However, it can be seen from the drawing that the raw edge 32 typically will lose most of its original folded position by the time it reaches the sewing needles 28.

Figure 1:
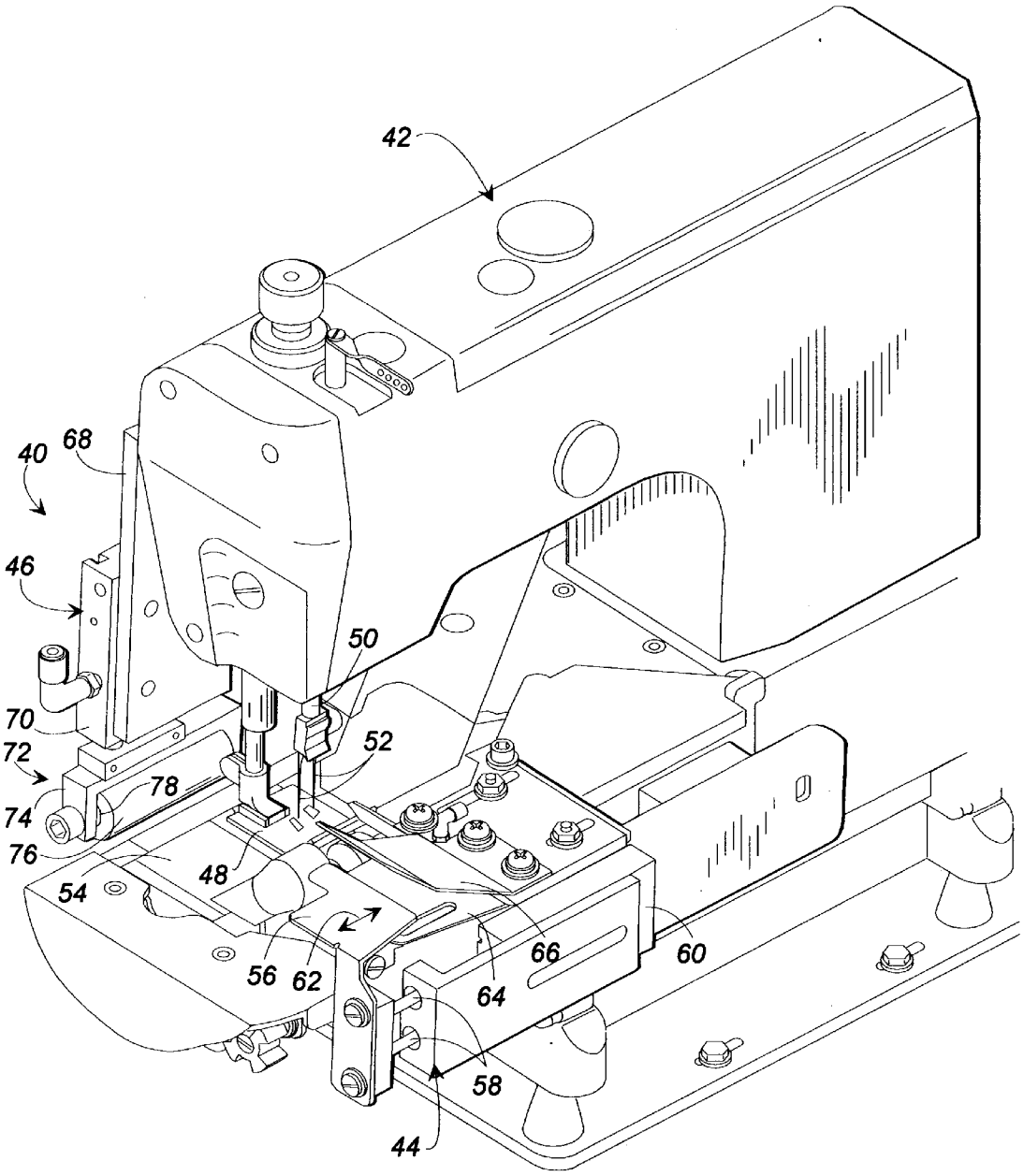
FIG. 1 is a perspective illustration of the textile fold control system for use at a sewing station which includes a sewing machine, a folder, and a hem engager.

FIG. 1 illustrates an embodiment of this invention in which a textile fold control system 40 is provided, and which includes a sewing station 92 (FIGS. 4 and 5) having a conventional sewing machine 42, a folder 44 positioned upstream of the sewing machine, and a hem engager 46 positioned downstream of the sewing machine. The sewing machine generally includes a presser foot 48, a needle bar 50, and a spaced pair of sewing needles 52 which are arranged to reciprocate through the presser foot and through a work piece 53 (FIGS. 4 and 5) advanced below the presser foot and through the sewing machine. The sewing machine also includes a work surface 54 (FIG. 1) that is substantially flat and horizontal, and on which the work piece will slide as it is advanced through the sewing station.

As shown in FIG. 1, the folder 44 is mounted upstream of the sewing needles 52 and includes a folder tongue 56 mounted on a spaced pair of cylinder rods 58 provided as a part of a pneumatically actuated cylinder assembly 60. Cylinder assembly 60 is operated by a central machine controller (not illustrated) provided for automating both the fold control system and the sewing machine used therewith. The cylinder assembly 60 controls the movement of the folder tongue and a pair of opposed folder plates 64 and 66 so that the folder tongue 56 reciprocates in the direction indicated by double-headed arrow 62 (FIG. 1) into and out of the space defined between the fold plates 64 and 66. The folder tongue 56 and the fold plates 64 and 66 form a C-shaped opening for the oncoming edge 86 (FIG. 5) of the work piece, so as to form the edge into a C-shaped folded hem, with the edge portion of the work piece being folded beneath the adjacent body portion 90 of the work piece.

A support plate 68 (FIG. 1) is mounted to the downstream side of the sewing machine 42, and supports the hem engager 46. Hem engager 46 includes a pneumatically actuated cylinder 70 and a roller assembly 72 that is controlled by the cylinder rods (not shown) of the cylinder 70 to raise and lower the roller assembly with respect to the work piece as it passes beyond the sewing machine. The roller assembly 72 includes a roller support yoke 74 and a freely rotatable idler roller 76 (FIGS. 1, 4) mounted on an axle 78, with the axle supported at its ends by the yoke 74. The hem engager 46 is positioned initially at a height wherein its roller 76 is held above the level of the work surface 54 of the sewing machine in a nonoperative position with the roller out of contact with the work piece 53. When the roller 76 is dropped to its lowered operative position (FIG. 4) by the cylinder 70, the lower portion of the roller is at a level lower than the level of the work surface 54 of the bed of the sewing machine so as to engage and lightly bend the work piece about the downstream or trailing edge 79 of the work surface of the sewing machine.

Figure 5:
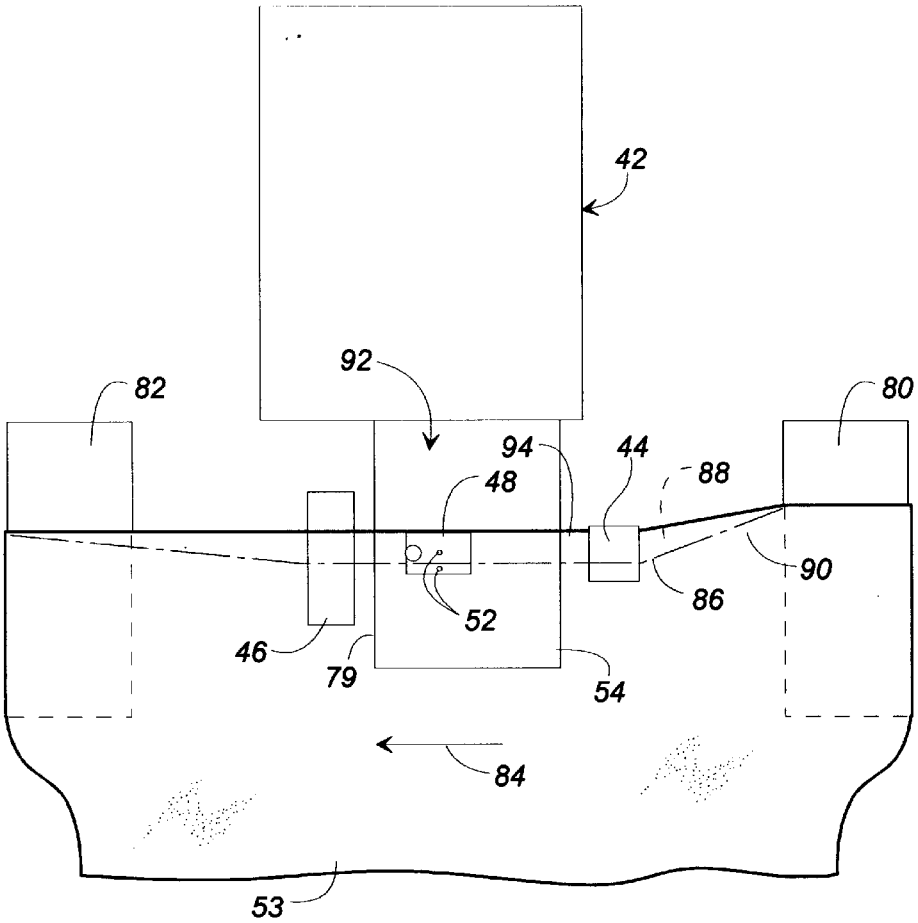
FIG. 5 is a schematic plan view of the textile fold control system and the sewing machine of FIG. 4, showing how the fold in the hem of the work piece is formed and is maintained across the work surface of the sewing machine during the pre-feed portion of the cycle of operation of the system.
Figure 4:
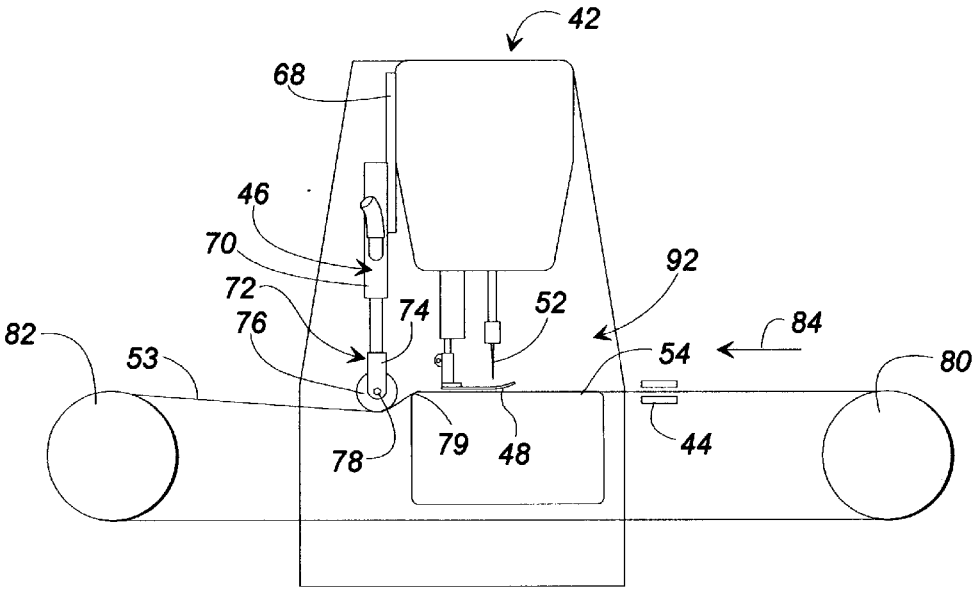
FIG. 4 is a schematic end elevational view of the sewing machine and the hem engager of FIG. 1, illustrating the movement of a work piece therethrough as it is engaged by the hem engager and passes off of the edge of a work surface of the sewing machine.

As illustrated in FIGS. 4 and 5, spindles 80 and 82 receive the work piece 53 and advance the work piece in a lightly stretched condition along a processing path extending in the directions indicated by arrow 84 through the sewing station 92 of the sewing machine 42, with the raw hem edge 86 of the work piece passing across the flat horizontal work surface 54 of the sewing machine, beneath the presser foot 48. The folder 44 turns the raw edge 86 and its adjacent edge portion 88 beneath the adjacent body portion 90 of the work piece, completing a fold or hem 94. The hem 94 is advanced from the folder 44 across the work surface 54, and beneath the presser foot 48 and needles 52.

When the hem engager 46 lowers its roller 76 to a level lower than that of the work surface 54, the roller of the hem engager lightly engages the work piece 53 downstream of the work surface 54 so as to depress and tension the work piece slightly at a position beyond the work surface 54. This tends to bend the work piece about the trailing edge 79 of the work surface 54, altering slightly the processing path 84 along which the folded hem is moved, so that increased frictional contact is made between the edge portion 88 folded under the work piece and adjacent body portion 90 of the work piece, so that the plies of the hem in the work piece will not shift or slide with respect to each other. Further, the bending of the work piece about the trailing edge 79 of the work surface 54 increases the friction between the edge portion of the work piece and the work surface, particularly between the work piece and the trailing edge 79 of the work surface. The tensioning of the work piece and the frictional engagement between the work piece and the work surface 54 helps to avoid curling of the edge portion 88 of the work piece.

As the work piece 53 continues to advance along the processing path, the hem 94 becomes more dimensionally stabilized and consistent in its dimensions from the folder 44 through at least the hem engager 46, extending across the work surface 54 and beneath the presser foot 48 and needles 52. Therefore, once the folder 44 and hem engager 46 have been actuated as described above, a proper and constant dimension hem will be formed after the work piece has been advanced only about one foot along the processing path.

Once the above described pre-feed operation has been accomplished so as to stabilize the hem/fold in the edge of the work piece, the presser foot 48 is lowered and the needles 52 begin their normal sewing function so as to form lines of stitching adjacent the raw edge 86 of the work piece and to progressively connect the raw edge of the work piece to the adjacent body portion, progressively completing the hem. After the sewing function has started, the stitching formed in the hem will hold the hem in place and the hem engager 46 may raise its roller 76 out of the path of the oncoming work piece for the completion of a sewing cycle.

While the hem engager 46 is described as including a roller 76 for the purpose of bending the hem and creating additional friction between the hem and the work surface of the sewing machine, and between the plies of the hem in the work piece to therefore avoid the slippage and unfolding of the plies of the work piece, all of which functions as a means for holding the hem in position prior to the start of sewing operations, it will be understood that other devices for holding the hem can be utilized for accomplishing the same or a similar function. For example, while a single roller 76 is illustrated, it is anticipated that a pair of rollers could be used, with the hem of the work piece passing between the rollers and the rollers being effectively brought together to urge the plies of the hem into frictional contact with each other. Also, it will be understood by those skilled in the art that the means for holding the hem could include other mechanical devices for bending the hem of the work piece, or applying a light force against the hem, thus establishing the desired frictional contact in the hem at a position downstream of the sewing station.

While the foregoing description discloses preferred embodiments of the invention, it will be understood by those skilled in the art that variations and modifications can be made thereto without departing from the spirit and scope of the invention as set forth in the following claims. In addition, the corresponding structures, materials, acts and equivalents of all means or step plus elements in the claims are intended to include any structure, material or acts for performing the functions in combination with other claimed elements, as specifically claimed herein below.

We claim:

1. A method of retaining a folded hem formed in a textile work piece, in which an edge portion of the work piece has been folded over onto an adjacent body portion of the work piece to form the hem, and the hem is advanced along its length over an upwardly facing work surface of a sewing machine, comprising the steps of:

applying tension to the edge portion and the adjacent body portion of the work piece;

after the hem of the work piece has passed over the work surface of the sewing machine, selectively moving a hem engager into engagement with the hem; and urging the hem downwardly with the hem engager to a level below the work surface with a force sufficient to maintain the folded hem in the work piece prior to sewing.

2. The method of claim 1 and wherein the step of selectively moving a hem engager into engagement with the hem comprises moving a roller toward engagement with the hem of the work piece.

3. The method of claim 1 and wherein the step of urging the hem downwardly comprises the step of bending the hem about a trailing edge of the work surface.

4. A method of forming a fold in a textile work piece having a continuous raw edge, an edge portion adjacent its raw edge, and an adjacent body portion adjacent the edge portion, as the textile work piece is advanced across the work surface of a sewing machine, comprising the steps of:

advancing the raw edge portion of the work piece in a stretched, unfolded condition across the work surface of the sewing machine;

progressively turning the raw edge portion under the adjacent body portion of the work piece to form a fold along the edge portion of the work piece as the work piece advances toward the work surface of the sewing machine;

advancing the fold across and beyond the work surface of the sewing machine;

selectively moving a hem engager into contact with the fold with the work piece passing thereunder; and urging the fold downwardly with the hem engager as the fold of the work piece moves beyond the work surface so as to bend the work piece and urge the raw edge portion and the body portion of the work piece into frictional contact with one another.

5. The method of claim 4 and wherein the step of urging the fold downwardly includes the step of urging the edge portion of the fold against the work surface and retarding the formation of a curl in the edge portion of the work piece in response thereto.

6. The method of claim 4 and wherein the step of selectively moving a hem engager into contact with the fold comprises the step of engaging the fold with a roller to depress the work piece as the work piece advances thereunder and beyond the work surface.

7. An apparatus for forming a folded hem in the edge portion of a work piece comprising:

a sewing machine having a horizontal work surface;

means for advancing a continuous edge portion of a work piece along a processing path extending across said work surface of said sewing machine;

a folder positioned along the processing path upstream of said sewing machine to engage an edge portion of the work piece and form a hem in the work piece as the work piece advances toward said sewing machine; and a hem engager positioned along the processing path downstream of said sewing machine and selectively movable into and out of the processing path, for engaging and holding the hem in the work piece as the hem advances across said work surface of said sewing machine prior to sewing.

8. The apparatus of claim 7 and wherein said hem engager comprises a roller selectively movable into and out of engagement with the hem.

9. The apparatus of claim 7 and wherein said hem engager comprises a cylinder and a roller movable by said cylinder into engagement with the hem for altering the processing path along which the hem is moved as the hem moves off of the work surface of the sewing machine.

10. A method of forming a folded hem in a tubular textile work piece which includes a continuous edge portion and an adjacent body portion, said method comprising the steps of:

advancing the edge portion and the adjacent body portion in an unfolded configuration along a processing path and across a work surface of a sewing machine;

progressively turning the edge portion under the adjacent body portion at a position along the processing path upstream of the sewing machine and forming a folded hem in the work piece upstream of the sewing machine, and advancing the folded hem across and beyond the work surface of the sewing machine;

applying a hem engagement means against the folded hem at a position along the processing path downstream of the sewing machine to increase frictional contact between said edge portion and said work surface, and between said edge portion and said adjacent body portion, to retard slippage between said edge portion and said adjacent body portion and to retard curl formation along the edge portion of the work piece for a length of advancement sufficient to stabilize the hem;

after the hem has become stabilized, sewing the edge portion to the adjacent body portion to complete formation of the hem; and terminating the application of the hem engagement means against the folded hem after the step of sewing the hem has begun.

11. The method of claim 10 and wherein the step of applying the hem engagement means against the hem comprises the step of engaging an idler roller against the hem with a force sufficient to change the direction of advancement of the hem along the processing path as the hem advances off of the work surface of the sewing machine.

* * * * *